US005171932A

United States Patent [19]

McElroy

[11] Patent Number: 5,171,932

[45] Date of Patent: Dec. 15, 1992

[54] ELECTROTHERMAL CHEMICAL PROPULSION APPARATUS AND METHOD FOR PROPELLING A PROJECTILE

[75] Inventor: Hugh A. McElroy, St. Petersburg, Fla.

[73] Assignee: Olin Corporation, Cheshire, Conn.

[21] Appl. No.: 768,794

[22] Filed: Sep. 30, 1991

[51] Int. Cl.[5] ..... F41B 6/00

[52] U.S. Cl. ..... 89/8; 102/700

[58] Field of Search ..... 89/8; 102/430, 431, 102/432, 433, 472, 700

[56] References Cited

U.S. PATENT DOCUMENTS

| | | | |
|---|---|---|---|
| 2,899,864 | 8/1959 | Bloxsom | 89/8 |
| 2,926,566 | 3/1960 | Atkins et al. | 102/472 |
| 3,967,552 | 7/1976 | Settles et al. | 102/430 |
| 4,534,263 | 8/1985 | Heyne et al. | 89/8 |
| 4,555,972 | 12/1985 | Heyne | 89/8 |
| 4,590,842 | 5/1986 | Goldstein et al. | 89/8 |
| 4,625,618 | 12/1986 | Howanick | 89/8 |
| 4,640,180 | 2/1987 | Rose | 89/8 |
| 4,711,154 | 12/1987 | Chryssomallis et al. | 89/8 |
| 4,715,261 | 12/1987 | Goldstein et al. | 89/8 |
| 4,840,106 | 6/1989 | Jasper, Jr. | 89/8 |
| 4,895,062 | 1/1990 | Chryssomallis et al. | 89/8 |
| 4,901,620 | 2/1990 | Kemeny | 89/8 |
| 4,901,621 | 2/1990 | Tidman | 89/8 |
| 4,907,487 | 3/1990 | Tidman et al. | 89/8 |
| 4,913,029 | 4/1990 | Tidman et al. | 89/8 |
| 4,930,394 | 6/1990 | Zwingel et al. | 89/8 |

*Primary Examiner*—Stephen C. Bentley
*Attorney, Agent, or Firm*—Bruce E. Burdick

[57] ABSTRACT

An electrothermal-chemical propulsion apparatus and method for propelling a projectile through a gun tube. The apparatus comprises a vaporizable energy coupling device between a projectile and at least one chemical propellant module. Vaporization of the coupling device creates a plasma which augments the gas expansion behind the accelerating projectile at a predetermined time after ignition of the chemical propellant. The coupling device is preferably a pair of concentric extensible sleeves telescopically folded and collapsed behind the projectile, each having one terminal end connected to the rear of the projectile and the other terminal emd connected through the propellant module to electrodes in the breech of the gun and in turn to an electrical power supply.

44 Claims, 3 Drawing Sheets

ELECTROTHERMAL CHEMICAL PROPULSION APPARATUS AND METHOD FOR PROPELLING A PROJECTILE

BACKGROUND OF THE INVENTION

This invention generally relates to electrothermal guns and more particularly to a propulsion apparatus employing a chemical propellant augmented by transmission and deposition of electrical energy in the form of a plasma.

Various schemes have been investigated over the years to enhance the energy output of conventional guns and cannons. For example various liquid propellant and travelinq charge concepts have been explored for the purpose of achieving higher performance levels. Various electrical gun schemes, electrothermal (ET) and electrothermal-chemical (ET-C) schemes, electromagnetic launchers and coil guns have also been proposed to attempt to improve the energy output of modern weapons.

Examples of these guns are disclosed in U.S. Pat. Nos. 4,907,487, 4,913,029, 4,715,261, 4,590,842, 4,711,154, 4,895,062, 4,555,972, and 4,640,180. Developments in electromagnetic launchers or rail guns are disclosed in U.S. Pat. Nos. 4,534,263, 4,840,106, 4,901,620, and 4,901,621.

The first two patents listed above, 4,907,487 and 4,913,029 both teach forming a low temperature plasma behind a projectile made in general of a high strength dielectric by vaporizing a fluidizable dielectric material such as polyethylene beads, water or lithium hydride and ohmically heating the plasma to accelerate the projectile through a gun tube lined also with a fluidizable low atomic weight material such as polyethylene. The polyethylene lining is simultaneously vaporized, augmenting the plasma Pressure behind the projectile to achieve a muzzle velocity of on the order of 10 Km/second.

U.S. Pat. No. 4,715,261 similarly discloses a projectile accelerated by a plasma. However, in this case the plasma is supplied to the rear of the projectile through a capillary tube behind the projectile containing an ionizable dielectric. A discharge voltage is applied to the dielectric forming the plasma.

U.S. Pat. No. 4,590,842 discloses accelerating a projectile through a gun tube by sequentially injecting a pulsed high Pressure plasma into the volume behind the projectile through spaced capillary injection tubes discharging into the gun tube at spaced intervals along the gun tube as it travels through the tube. The high pressure plasma is generated by vaporizing a dielectric lining in the capillary tubes.

U.S. Pat. No. 4,640,180 discloses augmenting a chemically propelled projectile by generating an electromagnetic field in the propellant gas during the combustion process. The propellant chamber is surrounded by a helical coil through which a high current is passed when chamber pressure rises to a preset value to produce eddy currents in the plasma, further heating the plasma creating a boost in chamber pressure to further accelerate the projectile. Alternatively, an electrical arc is generated in the propellant chamber during the chemical propellant combustion which ohmically further heats the propellant gases to achieve the same result.

U.S. Pat. No. 4,711,154 discloses a plasma injector for injecting a combustible fuel into the chamber behind a projectile which contains an oxidizer. The fuel injection rate into the oxidizing chamber is controlled by the electrical current pulse applied to the plasma injector. The plasma injector is a capillary tube which contains dielectric beads. An electrical pulse creates an arc through the beads (polyethylene), vaporizing them and producing a high pressure plasma of partially ionized ethylene which is injected into the oxidizer in the propellant chamber. The oxidizer, preferably hydrogen peroxide, then combusts the ethylene fuel to produce the propellant gas to accelerate the projectile.

U.S. Pat. No. 4,895,062 discloses an improved augmented plasma gun similar to that described in U.S. Pat. No. 4,711,154 but having an additional second fuel adjacent the oxidizer and in front of the capillary tube containing the dielectric beads which form the initial plasma upon imposition of a current pulse through the capillary tube. A fuse wire longitudinally disposed in the capillary chamber is vaporized by the current Pulse passing through it creating the heated plasma of ionizing gas, maintaining an electrical current path through the fuel in the capillary tube. This produces a jet of ionized gas injected into the fuel and the oxidizer chambers to begin the combustion process.

U.S. Pat. No. 4,555,972 discloses an electromagnetic launcher in tandem with a chemical projectile accelerator. The projectile accelerator is a conventional rifled barrel and cartridge chamber arrangement. The projectile is a dielectric saboted projectile preferably having a metallic armature on its rear end. Alternatively, a plasma armature is formed just behind the projectile. The rails of the electromagnetic launcher portion are pulsed with a high current source as the projectile enters one end of the launcher. The current pulse creates an arc behind the projectile passing through the armature, further accelerating the projectile through the bore. The armature in the rear of the projectile and the rails constitute essentially a one turn linear motor.

U.S. Pat. No. 4,930,394 teaches a hybrid electrothermal chemical propulsion system for a projectile wherein fluid propellant components are reacted and the gases Produced thereby are forcibly conducted past a plasma arc electrode arrangement which couples the thermal energy of the arc discharge into the gases streaming by.

One of the major problems encountered with the electrothermal gun concepts is that the generation, storage, and transfer of the electrical energy necessary to achieve the desired performance levels requires heavy and bulky components which are impractical. The electrothermal-chemical (ET-C) propulsion concepts are particularly attractive because of reduced bulk and the total energy release may be controlled or modulated by a metering or other control of the electrical energy input a described in the patents discussed above.

However, the practitioners of the art have to date relied on the creation of plasmas, arcs, and other electrical discharges for the purpose of exciting, ejecting, modulating and combusting various chemical mixtures, compounds and propellant formulations, usually as liquids, slurries, etc .

Army ET-C weapon tests and liquid propellant gun tests have so far both exhibited excessive pressure variations and excursions or spikes during high energy firings. These excursions or spikes have led to permanent deformation of the gun tubes and uncontrollable impulses delivered to the projectiles resulting in their structural failure and unacceptable muzzle velocity variations, These test results are but symptoms of the actual lack of combustion control exhibited by the various ET-C schemes used to date when coupled with the various working fluids used. It is believed that certain schemes such as that disclosed in U.S. Pat. Nos. 4,722,154 and 4,895,062 discussed above, will not scale in a straight forward nor practical fashion when applied to much larger geometries such as high performance tank cannons and large artillery systems. The reasons for this are not entirely clear at this time.

One reason identified is the requirement for a multiplicity of the contained high pressure plasma generation devices in such systems. These devices must structurally be able to withstand very high internal pressures on the order of 50,000 to 100,000 psi, necessitating heavily constructed and bulky structures. Such structures must also exhibit virtually identical electrical load characteristics and therefore energy coupling characteristics both during the single ballistic cycle and as well as shot to shot in order to uniformly and repeatably ignite and modulate the combustion of an inherently unstable and chaotic combustion process such as is presented by liquid propellants and working fluids.

This is especially true for the bipropellant systems where the mixing process is also initiated and maintained or modulated by the high energy plasma and the excited fuel and oxidizer species carried along and entrained in the discharge. Accordingly, there is a need for an improved electrothermal chemical scheme to achieve improved performance in large scale applications such as tank cannons and artillery.

The present invention draws from the combined technologies of solid propellant propulsion and electrothermal propulsion, neither of which teach such a hybrid combination as will be shortly described.

In solid propellant propulsion devices one or more energetic and nonenergetic materials are combined in such a fashion as to produce a solid grain of propellant with specific structural and chemical energy characteristics as well as contained chemical energy release characteristics. These characteristics can be controlled by the geometry, chemistry, and environment in which the grain is used. The environment includes initial propellant temperature, igniter system output energy and duration, as well as resultant initial pressure, chamber volume, bore diameter, projectile mass, and the travel distance of the projectile within the gun bore. This technology represents a very mature technology base. It is in fact the baseline to which all new propulsion concepts are measured.

The Electrothermal (ET) and electrothermal chemical (ET-C) systems as applied to large guns are both new technologies. These devices utilize the electrical output of rotating machinery or some other prime electrical source through a pulse forming network consisting of capacitors and inductors energizing the cathode of the system. A dielectric breakdown plasma is directed to a chamber containing an inert working fluid (as in the case of Pure ET) which is vaporized to provide gas pressure to eject or propel a projectile. Also in the case of pure ET the resulting device has the serious drawback at this time of being very bulky due to the excessive size of the required electrical power supply. In the case of the ET-C systems, the electrical power supply promises to be much smaller since not all of the energy required to propel the projectile need come from the electrical energy source.

SUMMARY OF THE INVENTION

The present invention is directed to augmentation and/or modulation of a chemical propellant system with electrical energy. In particular, the p resent invention applies to a large caliber system such as the 155 mm artillery system but is not limited thereto. Other caliber systems can utilize the principles of the present invention. The 155 mm system described below is presently the preferred embodiment.

This 155 mm system utilizes separate ammunition and has a chamber which is substantially the same diameter as the gun bore. The ammunition is thus a projectile and one or more Propellant charge modules loaded into the gun breech behind the projectile.

The propulsion apparatus of the present invention includes a coaxial plasma energy coupling device behind the projectile and preferably between the projectile and the charge modules to couple electrical energy from an external conventional electrical power supply to the expanding chemical gases resulting from combustion of the solid propellant grain or grains. This coaxial coupling device is essentially a conductive vaporizable element. It preferably includes an extensible conductive element disposed coaxially behind the projectile and in front of the propellant charge modules as well as passing through the charge modules.

This extensible element unfolds, stretches or telescopes behind the projectile as the chemical propellant gases evolve and push the projectile down the gun bore. The extensible element maintains electrical continuity preferably between a rear end face of the projectile and electrodes in the rear face of the gun breech through conductive elements incorporated into or extending through the propellant charge modules. Continuity is maintained until the element is fully extended behind the projectile, at which time an electrical current pulse through the element vaporizes the element, creating a plasma augmenting the expanding gasses behind the projectile.

Thus the apparatus in accordance with the present invention incorporating the coaxial energy coupling device preferably consists of severable parts assembled together to form a cartridge or, in the case of the 155 mm gun, a propelling charge assembly as the projectile and the propellant charge modules are separately loaded into the 155 mm gun.

In the simplest embodiment of the invention, the coaxial energy coupling device comprises a pair of electrical conductors which extend axially through the propellant charge behind the projectile. The conductors are vaporized by passage of a sufficient electrical current pulse therethrough at the appropriate instant after the charge is ignited. The vaporization of the conductors forms a plasma which transfers energy into the expanding combustion gases. The conductors may be structural components of the propelling charge or they ma be separate members positioned in the gun chamber.

The assembly preferably comprises a projectile, an extensible energy coupling device, and one or more unitary charge modules having electrically conductive structural members loaded in tandem behind the coupling device.

The structural members may be incorporated into the casing of the charge module, embedded in the propellant charge module or as added assemblages such as concentric tubes slipped over the basic charge module with end caps affixed to provide electrical connections to the gun breech and to the coupling device.

The extensible element or device may be coiled wire, a helically braided conductive mesh, a series of interconnected braids, or telescoping sleeves in front of or surrounding the propellant charge or a combination of the above. In the preferred embodiment, the extensible coaxial energy coupling device includes an inner sleeve and an outer sleeve of helically braided wire mesh material concentric to the inner sleeve. Each sleeve is axially collapsed and concentrically folded an an axial accordion fashion analogous to a common chinese finger puzzle. The inner sleeve has a smaller outer folded diameter than the folded inner diameter of the outer sleeve so that the sleeves are radially spaced from each other when collapsed and during extension.

One terminal end of each sleeve is connected to a solid conductor disk attached to the base of the projectile. The other terminal end of each sleeve is connected to ring shaped electrodes which in turn electrically connect to the power source through the breech end of the gun. These electrodes mate with matching ring conductors which are part of the ends of each propellant module.

Each propellant module has a cylindrical toroidal case housing a propellant charge therein. The case of the module has an inner and an outer tubular wall and annular end faces. The flat end faces of the module are preferably made of a conductive combustible material. The annular flat ends constitute electrical contacts which mate with the end faces of the adjacent modules or, at the forward end, with the rear terminal ends of the sleeves and at the aft end of the chamber, with the terminals in the rear face of the breech.

The coaxial coupling device in the overall assembly will follow the moving projectile down the gun bore extending and maintaining electrical continuity until such time as the device is fully extended. At that instant of time, an electrical current pulse is passed through the sleeves to vaporize the device creating a plasma. This couples electrical, thermal, magnetic and magnetohydrodynamic energy into the ballistic system to substantially augment the energy propelling the projectile.

The timing and amount of electrical energy provided to the energy coupling device is selected so that the projectile is accelerating down the bore at a rate such that as high pressures and high temperatures are generated the energy transferred is optimized and rapidly transferred to the projectile motion though an adiabatic expansion process. This keeps the actual gun gas pressures and temperatures at a much lower level than if the electrical energy (Plasmas) were introduced earlier in or during the very early phases of the ballistic cycle. The ballistic effect of this scheme is to produce a very high level of propellant burn rate progressivity. This occurs through a combination of energy transfer or deposit mechanisms (i.e. thermal, electrical ionization effects on combustion processes—burn rate, kinetic, and modulated localized pressure gradients also affecting burn rates) added into a conventional or specially modified propellant system at a time of choice and to a desired degree.

In the case of a high energy, high velocity and high acceleration system such as a tank gun the coupling device in accordance with the invention in a non-extensible or static mode could be utilized not only with a working fluid produced from combustion of a solid propellant charge module as above described, but the working fluid could also be a gelled liquid, slurry or solids suspended in a gelled liquid. (Note: a gelled liquid is always preferred over a simple liquid.)

These and other features, aspects and advantages of the present invention will become more apparent upon a reading of the following detailed description of the invention in conjunction with the accompanying drawing.

DETAILED DESCRIPTION OF THE PREFERRED EMBODIMENT

Figure 1:
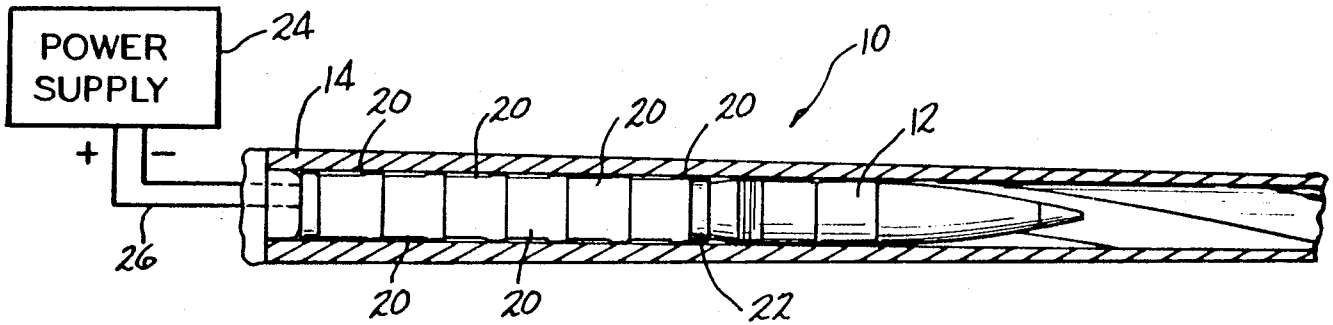
FIG. 1 is a longitudinal partial sectional view of one preferred embodiment of the assembled projectile propelling system .in accordance with the invention loaded into the breech of a cannon.

Turning now to FIG. 1 of the drawing, a propelling apparatus 10 in accordance with the invention is shown. The apparatus 10 comprises a projectile 12 loaded through the breech end 14 of a gun chamber 16 so as to project into the gun tube 18, a plurality of propelling charge modules 20 loaded behind the projectile 12, an extensible conductive coupling device 22 between the projectile 10 and the charge modules 20, and a power supply 24 connected via leads 26 through the rear end 14 of the chamber 16 to the charge modules 20 and to the coupling device 22.

An ignition device (not shown) of conventional design also is coupled through the breech end 14 to the propelling charge modules 20. Upon ignition, the charge modules 20 burn rapidly and progressively to generate a high gas pressure transient within the chamber 16.

Figure 2:
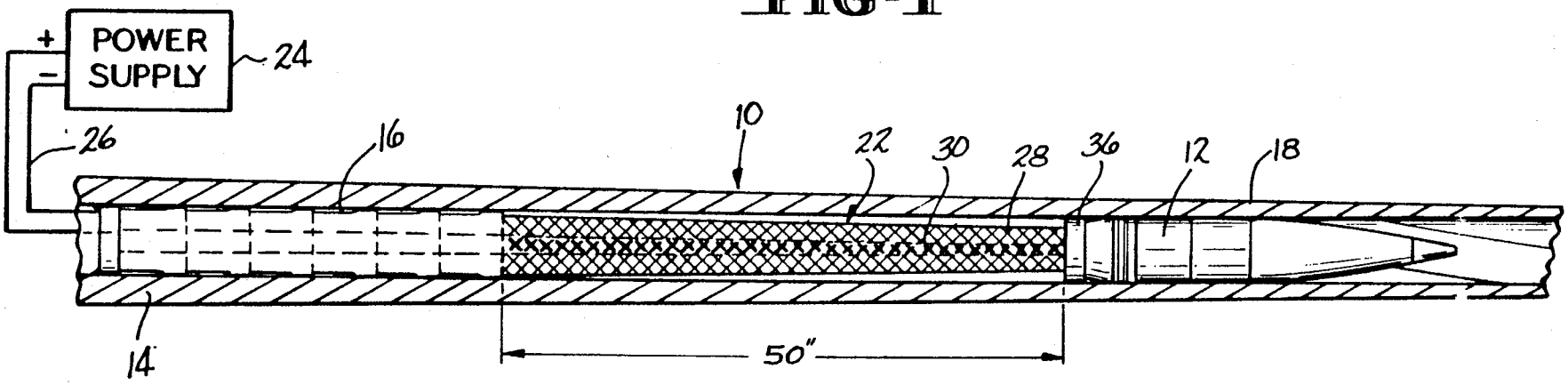
FIG. 2 is the same view as in FIG. 1 after propellant ignition and just before triggering a high current electrical Pulse into the extended concentric tubular mesh members connected to the projectile.

This gas pressure begins to accelerate the projectile through the gun tube 18 as is shown in FIG. 2. As the projectile 12 moves through the gun tube 18, this gas pressure tends to peak and then begin to decrease. It is at this point that the coupling device 22 of the invention is designed to optimally function to sustain the pressure impulse on the projectile 12. The coupling device 22 should be almost fully extended at this point. An electrical pulse is then fed from the power supply 24 through the coupling device 22 vaporizing it creating an augmenting plasma behind the projectile 12 thus adding energy to the expanding gasses. This energy increases the pressure on the rear of the projectile 12 thus increasing the muzzle velocity of the projectile without substantially increasing the chamber pressure of the gun.

The coaxial energy coupling device 22 includes an outer sleeve 28 and an inner sleeve 30 concentric to the inner sleeve 28. Each sleeve 28 and 30 is preferably made of a helical wire mesh or braid axially collapsed analogous to a common chinese finger puzzle and concentrically folded an an axial accordion fashion. The outer sleeve 28 has a larger inner folded diameter than the folded outer diameter of the inner sleeve 30 so that the sleeves are nested together when folded and concentrically spaced from each other when extended. The wire used can be copper, silver, carbon or plated boron fibers. The plating on the wires could also include a decoppering agent.

Sleeve 28 has one terminal end 32 attached to a conductive coaxial metal plate 34 which abuts against a projectile end cap 36. The other terminal end of the sleeve 28 is connected to an outer contact ring 38 which in turn contacts the forward most propellant charge module 20 as will be subsequently described.

The inner sleeve 30 similarly has one end 40 attached to the metal plate 34 and its other terminal end connected to an inner contact ring 42 which is also connected to the the forward most propellant charge module 20 as will be subsequently described. Both sleeves are collapsed and folded concentrically and sleeve 30 is disposed radially inwardly of sleeve 28 in the collapsed condition.

The braid material of sleeves 28 and 30 may include a plating of a decoppering agent. The fibers of the braid may be boron filaments or carbon filaments which are coated with tungsten with an overlay of tin. This provides for axial extensive movement of the sleeve to about 50 inches down bore while twisting without breaking the filament strands.

The outer contact ring 38 may be made of copper or it may be a combustible substance or consumable substance such as nitrocellulose or polyurethane with an embedded conducting braid, or otherwise suitably treated for selective electrical conductivity. Ring 38 has an "L" shaped cross section so as to present a flat surface rearward against the forward most charge module. This provides a flat circular contact area and also encloses a portion of the sleeve 28. The inner contact ring 42 also may be metal such as copper or may be a combustible material such as cellulose or nitrocellulose with a conductive braid, coating or other material thereover or embedded therein so as to make the contact ring electrically conductive. The inner ring is spaced inwardly of the outer contact ring so as to be electrically separated from each other.

The contact rings 38 and 42 may alternatively be adhesively bonded to the charge module or may be metal hook and loop fastener fabric hook pads designed to attach to corresponding loop pads on the end face of the charge module to ensure solid electrical contact therebetween.

Figure 3:
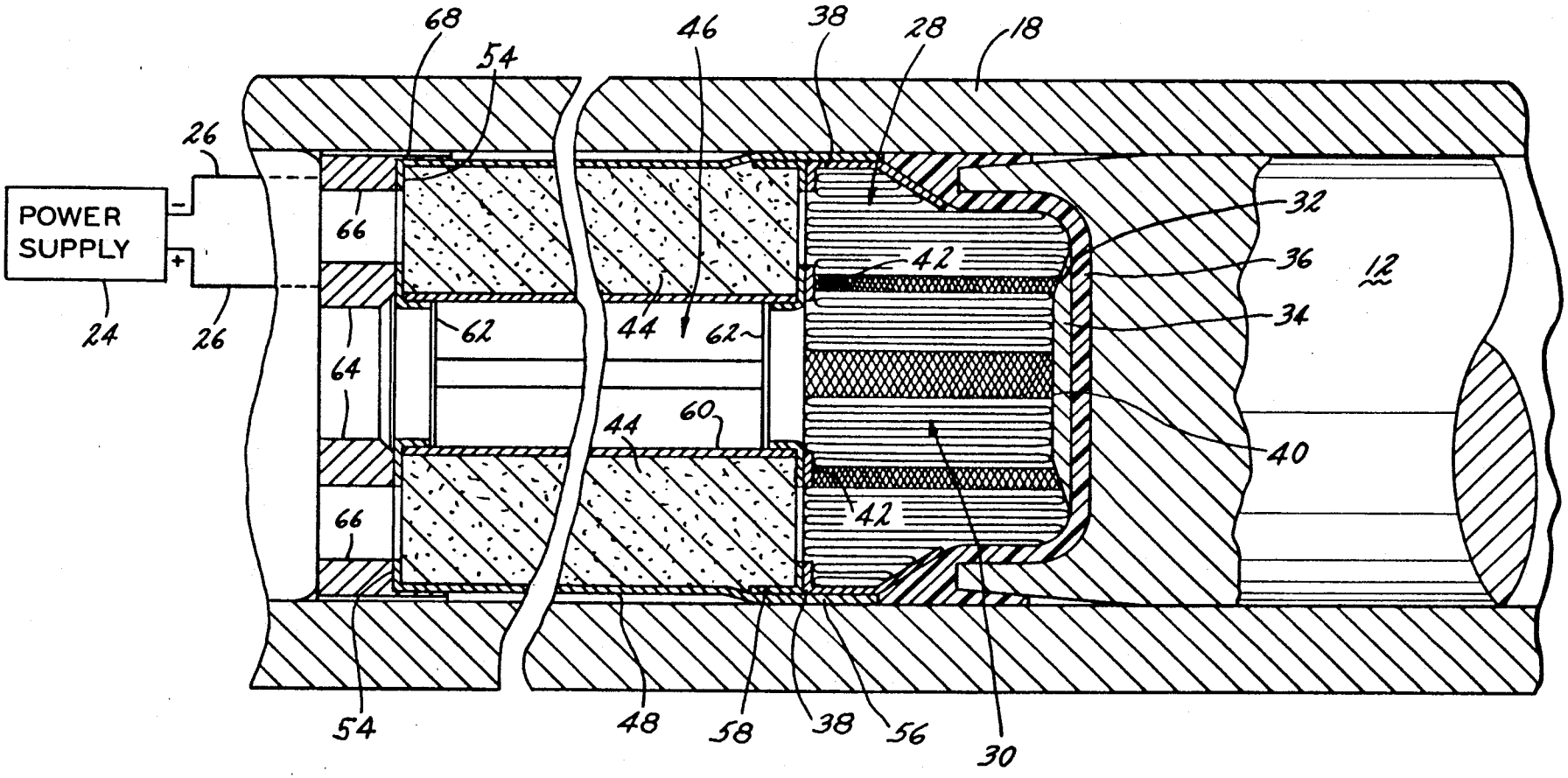
FIG. 3 is an enlarged sectional view of the assembled projectile and propellant in accordance with the invention shown in FIG. 1.

The end cap 36 functions as an elastomeric obturator and rear seal having a generally cupped shape. It is preferably made of silicone rubber or a room temperature vulcanizing plastic sealant type material. The end cap 36 contains the folded inner and outer sleeves 30 and 28 respectively and the conductive plate 34 and is in turn attached to the rear end of the projectile 12 or fits within a recess in the rear of the projectile 12 as shown in FIG. 3.

The conductive metal plate 34 is a relatively massive metal disk which is designed to withstand the high current pulse through the sleeves 28 and 30. This current pulse creates intense magnetic field in each of the wires of the braid which repulse each other. As the braid is moveable in an axial direction, the field causes an additional force to be exerted against the metal plate 34 which pushes against the rear of the projectile to further enhance the energy transfer into the propelling system.

Each of the propellant charge modules 20 is preferably comprised of a solid porous compacted charge 44 of Propellant such as Ball Powder® propellant. Other compacted propellants can be used but Ball Powder® is preferred. The charge modules 20 are described in detail in copending U. S. Application Ser. No. 07/575,057. However, in the present invention, the casing of the module is modified so as to be electrically conductive.

Figure 4:
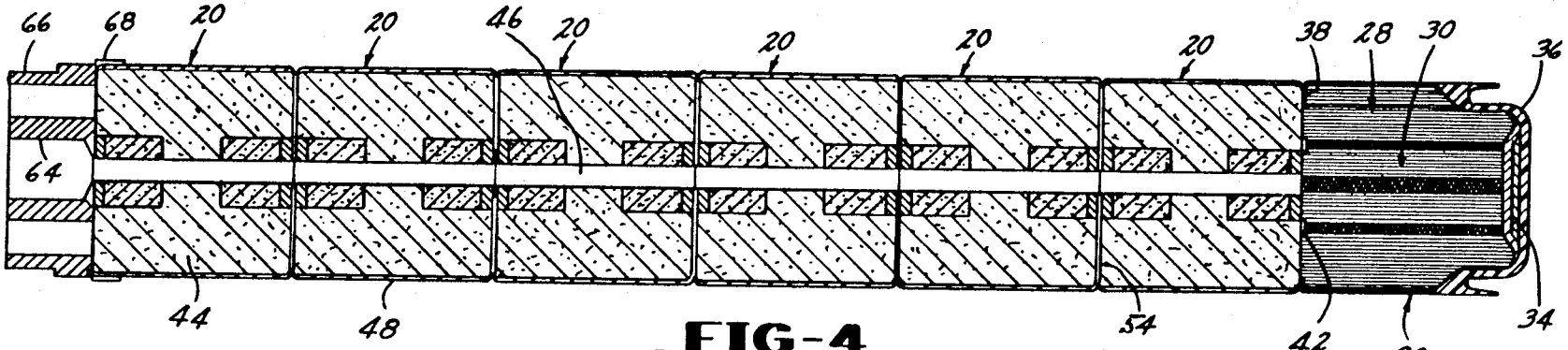
FIG. 4 is an enlarged sectional view of the assembled propelling charge in accordance with the invention.
Figure 5:
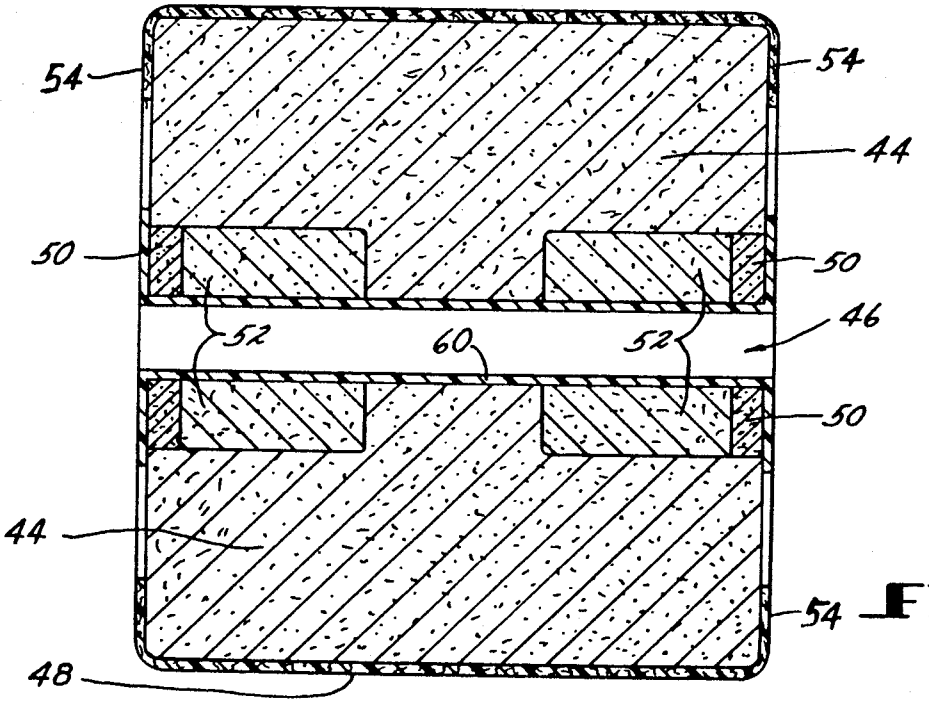
FIG. 5 is an enlarged sectional view of a charge module in accordance with the invention.

The charge 44 has a cylindrical annular or toroidal shape with a central through bore 46. The charge 44 is enclosed within an outer conductive combustible case 48 as shown in FIGS. 4 and 5. The central bore 46 also preferably contains an igniter charge ring 50 at each end and an initiating charge sleeve 52 therebetween to enhance symmetrical ignition and propagation of the flame front through the axially arranged propelling charge modules 20. The charge ring 50 and the charge sleeve 52 are both preferably solid porous bodies made of compacted propellant such as fine grain Ball Powder® propellant and are slip fitted within corresponding recesses in the charge 44.

The outer combustible case 48 is preferably made of conventional combustible cartridge case materials such as felted nitrocellulose and has either a conductive mesh embedded in the case wall or carbon or boron fibers which are coated with a conductive material distributed throughout so that the outer case 48 is electrically conductive. Alternatively, straps or strands of conductive material may be adhered to the inside or outside surface of the case to provide a conductive path from one end to the other of the outer case 48. The opposite ends of the case 48 are folded over the charge 44 so as to form outer ring contacts 54 which mate with the opposite ring contact 54 of the adjacent module 20 as is shown in FIG. 4.

The forwardmost charge module 20 may be constructed as in FIG. 4 or alternatively may have its front end extended axially to form a tubular contact surface 56 as shown in FIG. 3 for slipping over and engaging the outer contact ring 38 of the extensible device 22. In this case, an outer module end cap 58 is adhesively attached to the inside surface of the case 48. This cap 58 may also have metallic hook and loop fastener fabric loops to engage corresponding hooks on the surface of the outer contacting ring 38.

The bore 46 through charge 44 is lined with a combustible tube 60. The tube 60 is preferably constructed of the same material as the outer case 48 and is similarly electrically conductive. The ends of each tube 60 are folded radially outward so as to lock the tube in place along with the igniter sleeve and ring as is shown in FIG. 5.

Alternatively, as shown in FIG. 3, the tube 60 may terminate at the end of the bore 46 and an annular, flanged inner ring contact 62 may be adhesively bonded to the inner tube 60 at each end of the module. With either construction, the completed module forms a coaxial pair of tubular conductors which, when tandemly joined together as in FIG. 4, provide a conductive path from the aft end of the assembly through the coupling device 22 and back through the inner tubes.

The aft most module 20 has preferably attached thereto a pair of concentric inner and outer ring electrodes 64 and 66. A sleeve 68 around the outer electrode 66 fits over the aft end 52 of the case 48 of the rear most module 20. These electrodes are insulated from one another. The electrodes are preferably attached to the annular contacts 52 and 62 of the module cases 48 via contact or metal hook and loop fastener fabric complementary hook and loop pads. The power supply 24 connects to these electrodes 64 and 66 via leads 26 when the breech door of the gun is closed.

The apparatus according to the invention operates as follows. When the gun is fired, the ignition flame rapidly propagates through the central bore 46 through the modules to ignite the propellant rings 50 and 52 which in turn ignite the main charge bodies 44. The burning propellant creates an expanding gas pressure behind the projectile. As this pressure increases, the projectile begins to be pushed through the gun tube. As the projectile travels forward, the obturator end cap 36 remains tightly against the rear of the projectile. The Plate 34 also remains abutting the rear inside surface of the end cap 36 and is pushed forward, pulling the ends 32 and 40 of the inner and outer sleeves 30 and 28 along with the plate 34 thus extending the sleeves 30 and 28. The electrical continuity through the abutting tubes 60 and the outer tubes 48 remains intact as the propellant burns. thus continuity from inner electrode 64 to plate 36 and from plate 36 to electrode 66 is maintained. When the sleeves 30 and 28 are fully extended, at about 50 inches of projectile travel through the gun tube 18, a high current electrical Pulse is triggered by conventional means through leads 26 from the power supply 24. This pulse travels through electrode 64, cases 48, contact ring 38, sleeve 30, plate 36, sleeve 28, contact ring 42, flange contact rings 62, tubes 60 and finally through inner electrode 64 back to the power supply 24. This pulse is of such intensity that the sleeves 28 and 30 and the conductive case 48 and the conductive tubes 60 are instantly vaporized, creating a plasma of atoms and ion species which augment the gas pressure within the gun chamber. This augmentation sustains the pressure applied to the rear of the projectile to increase its muzzle velocity.

In addition, the high current through the path above described is believed to cause a repulsion force between the wires or filaments which is felt on the aft end of the projectile as an additional force. Finally, a magnetohydrodynamic force is generated by the plasma created which further acts against the rear face of the projectile to give it an additional boost through the gun tube.

Accordingly the method of augmenting propulsion of a projectile initially propelled by a chemical propellant charge through a gun tube comprises the steps of:

(a) providing an extensible vaporizable conductor behind said projectile;

(b) abutting one end of said conductor to a rear end of said projectile;

(c) Connecting an electrical power supply to another end of said conductor;

(d) igniting said chemical propellant to initially accelerate said projectile in said gun tube; and (e) vaporizing said conductor when said conductor is fully extended behind said projectile by passing a large electrical current pulse through said extensible conductor from the power supply.

Although the invention has been shown and described with reference to a preferred embodiment, other variations and modifications are contemplated as being within the scope of the invention. For example, the outer conductive path through the outer extensible sleeve 30 and outer cases 48 may be substituted by conduction through the gun tube itself. However, in this case, the quantity of material contributed to the plasma would be reduced. In another variation, wire braids as in the sleeves 28 and 30 could be embedded in the combustible case 48 and tubes 60 to provide the conductive paths.

Accordingly it is intended to embrace all such variations and modifications as defined by the scope of the appended claims. All patents, patent applications and other references referred to herein are hereby incorporated by reference in their entirety.

What is claimed is:

1. An apparatus for augmenting propulsion of a projectile propelled through a gun tube with a chemical propellant from within a gun chamber with electrical energy from an external electrical power supply comprising a conductor means positioned behind said said projectile in said gun chamber for conducting an electrical current therethrough after ignition of said chemical propellant, at least a portion of said conductor means being vaporizable in response to passing said current therethrough, and an extensible conductor means connected between said conductor means and said projectile, said extensible means adapted to extend behind said projectile in response to forward movement of said projectile through said gun tube, at least a portion of said extensible means being vaporizable in response to passing said current therethrough.

2. The apparatus according to claim 1 wherein said conductor means is an electrically conductive propellant charge module adapted to be connected to said extensible means.

3. The apparatus according to claim 2 further comprising means for passing said electrical current into said chamber to said conductor means and through said propellant charge module.

4. The apparatus according to claim 2 wherein said module comprises an annular shaped propellant charge, an outer conductive tube and an inner conductive tube containing said charge therebetween, said tubes having annular end portions forming concentrically spaced inner and outer end contacts at each end of said module.

5. An apparatus for augmenting propulsion of a projectile propelled through a gun tube by a chemical propellant from within a gun chamber with electrical energy from an external electrical power supply comprising:

an extensible conductor means positioned behind said said projectile in said chamber for conducting an electrical current therethrough, said means adapted to extend behind said projectile in response to forward movement of said projectile through said gun tube, at least a portion of said means being vaporizable in response to passing said current therethrough.

6. The apparatus according to claim 5 further comprising an electrically conductive propellant charge module adapted to be connected to said extensible means.

7. The apparatus according to claim 6 further comprising means for passing said electrical current into said chamber to said extensible means and through said propellant charge module.

8. The apparatus according to claim 6 wherein said module comprises an annular shaped propellant charge, an outer conductive tube and an inner conductive tube containing said charge therebetween, said tubes having annular end Portions forming concentrically spaced inner and outer end contacts over said charge at each end of said module.

9. The apparatus according to claim 7 wherein said tubes are consumable.

10. The apparatus according to claim 9 wherein said tubes contain an electrically conductive material embedded therein.

11. The apparatus according to claim 10 wherein said material is a conductive braid.

12. The apparatus according to claim 11 wherein said braid is copper having a coating of tin.

13. The apparatus according to claim 11 wherein said braid is made of coated boron fibers.

14. The apparatus according to claim 11 wherein said braid is made of carbon fibers.

15. The apparatus according to claim 5 wherein said conductor means includes at least one collapsible tubular sleeve of a conductive material concentrically folded so as to form a ring behind said projectile.

16. The apparatus according to claim 7 wherein further comprising a conductive plate member adapted to be transversely positioned behind and adjacent said projectile.

17. The apparatus according to claim 16 wherein said sleeve has one terminal end connected to said plate member.

18. The apparatus according to claim 17 wherein said sleeve has another terminal end connected to an outer ring shaped contact member.

19. The apparatus according to claim 17 wherein said conductive sleeve is a collapsible and extensible mesh.

20. The apparatus according to claim 19 wherein said conductive mesh is a wire mesh.

21. The apparatus according to claim 18 further comprising an inner sleeve concentrically folded within and spaced radially inwardly from said one sleeve.

22. The apparatus according to claim 21 wherein said another sleeve is a collapsible and extensible mesh.

23. The apparatus according to claim 22 wherein said conductive mesh is a wire mesh.

24. The apparatus according to claim 23 wherein said another sleeve has one terminal end connected to said plate member.

25. The apparatus according to claim 20 wherein said inner sleeve has another terminal end connected to an inner ring contact spaced from said outer ring contact.

26. The apparatus according to claim 8 wherein said conductor means includes at least one collapsible tubular sleeve of a conductive material concentrically folded so as to form a ring.

27. The apparatus according to claim 26 wherein said conductor means further comprises a conductive plate member adapted to be transversely positioned behind and adjacent a rear end of said projectile.

28. The apparatus according to claim 27 wherein said sleeve has one terminal end connected to said plate member.

29. The apparatus according to claim 28 wherein said sleeve has another terminal end connected to an outer ring shaped contact member adapted to contact said outer end contact on one end of said charge module.

30. The apparatus according to claim 29 wherein said conductive sleeve is a collapsible and extensible mesh.

31. The apparatus according to claim 30 wherein said conductive mesh is a wire mesh.

32. The apparatus according to claim 31 wherein said extensible means further comprises an inner sleeve concentrically folded within and spaced radially inwardly from said one sleeve.

33. The apparatus according to claim 32 wherein said inner sleeve is a collapsible and extensible mesh.

34. The apparatus according to claim 33 wherein said conductive mesh is a wire mesh.

35. The apparatus according to claim 34 wherein said another sleeve has one terminal end connected to said plate member.

36. The apparatus according to claim 35 wherein said inner sleeve has another terminal end connected to an inner ring contact spaced from said outer ring contact adapted to contact said inner end contact at said one end of said charge module.

37. The apparatus according to claim 8 further comprising a plurality of modules adapted to be tandemly arranged and connected together behind and connected to said extensible means.

38. The apparatus according to claim 7 wherein said propellant module comprises an outer conductive tube, an inner conductive tube, an annular shaped propellant charge contained therebetween, and a pair of annular end caps attached to said tubes at each end forming inner and outer annular spaced end contacts at fore and aft ends of said module.

39. The apparatus according to claim 38 wherein said propellant charge is a solid toroidal body of compressed spheroidal propellant grains.

40. The apparatus according to claim 39 wherein said tubes and said end caps contain a combustible resin material.

41. The apparatus according to claim 40 wherein said conductor means includes a pair of concentrically spaced collapsible tubular sleeves of a conductive mesh material concentrically folded so as to form a pair of concentric rings behind said projectile, a conductive plate member adapted to be transversely positioned behind and adjacent said projectile, and each of said sleeves has one terminal end connected to said plate member and the other terminal end connected to a ring shaped contact member.

42. The apparatus according to claim 41 wherein said conductive sleeve is a collapsible and extensible wire mesh.

43. A method of propelling a projectile from a gun chamber into and through a gun bore comprising the steps of:

(a) providing a chemical propellant behind said conductor in said chamber;

(b) providing an extensible vaporizing conductor behind said projectile;

(c) connecting an electrical current power supply to said conductor;

(d) igniting said chemical propellant charge to begin moving said projectile through said gun tube and extend said conductor; and (e) passing an electrical current through said extended extensible conductor so as to vaporize said conductor.

44. A method of augmenting propulsion of a projectile which is propelled by a chemical propellant charge through a gun bore comprising the steps of:

(a) positioning an extensible vaporizable conductor behind said projectile forward of said charge;

(b) igniting said chemical propellant behind said projectile to move said projectile and extend said conductor; and (c) passing an electrical current pulse through said extensible conductor when said conductor is fully extended behind said projectile so as to vaporize said conductor.

* * * * *